US008878623B2

(12) United States Patent
Kroening

(10) Patent No.: US 8,878,623 B2
(45) Date of Patent: Nov. 4, 2014

(54) SWITCHING FERRITE CIRCULATOR WITH AN ELECTRONICALLY SELECTABLE OPERATING FREQUENCY BAND

(75) Inventor: Adam M. Kroening, Atlanta, GA (US)

(73) Assignee: Honeywell International Inc., Morristown, NJ (US)

( * ) Notice: Subject to any disclaimer, the term of this patent is extended or adjusted under 35 U.S.C. 154(b) by 175 days.

(21) Appl. No.: 13/588,314

(22) Filed: Aug. 17, 2012

(65) Prior Publication Data

US 2014/0049332 A1 Feb. 20, 2014

(51) Int. Cl.
*H01P 1/383* (2006.01)
*H01P 1/38* (2006.01)

(52) U.S. Cl.
CPC . *H01P 1/383* (2013.01); *H01P 1/38* (2013.01)
USPC ..... 333/1.1

(58) Field of Classification Search
USPC ..... 333/1.1, 24.2
See application file for complete search history.

(56) References Cited

U.S. PATENT DOCUMENTS

| | | | |
|---|---|---|---|
| 3,070,760 | A | 12/1962 | Wheeler |
| 3,341,789 | A | 9/1967 | Goodman et al. |
| 3,935,548 | A | 1/1976 | Rosenbaum et al. |
| 4,058,780 | A | 11/1977 | Riblet |
| 4,309,666 | A | 1/1982 | Ito et al. |
| 4,604,590 | A | 8/1986 | Mlinar et al. |
| 4,697,158 | A | 9/1987 | Hoover et al. |
| 5,473,294 | A | 12/1995 | Mizzoni et al. |
| 6,292,068 | B1 | 9/2001 | Martin |
| 6,885,257 | B2 | 4/2005 | Kroening |
| 7,242,263 | B2 | 7/2007 | Kroening |
| 7,561,003 | B2 | 7/2009 | Kroening |
| 2003/0107447 | A1 | 6/2003 | Kroening |
| 2004/0119550 | A1 | 6/2004 | Trammell et al. |
| 2005/0179504 | A1 | 8/2005 | Kroening |
| 2006/0232353 | A1 | 10/2006 | Kroeing |

(Continued)

FOREIGN PATENT DOCUMENTS

| | | |
|---|---|---|
| DE | 3026257 | 2/1982 |
| EP | 0239210 | 9/1987 |

(Continued)

OTHER PUBLICATIONS

European Patent Office, "European Search Report", "from Foreign Counterpart of U.S. Appl. No. 13/588,314", Dec. 3, 2013, pp. 1-5, Published in: EP.

(Continued)

*Primary Examiner* — Stephen Jones
(74) *Attorney, Agent, or Firm* — Fogg & Powers LLC

(57) ABSTRACT

A ferrite element for a switchable circulator comprises a first segment extending in a first direction from a center portion of the ferrite element; a second segment extending in a second direction from the center portion of the ferrite element; and a third segment extending in a third direction from the center portion of the ferrite element. Each of the first segment, the second segment, and the third segment include a first channel located at a first distance from a center point of the ferrite element. The first distance defines a first resonant section of the ferrite element. Each of the first segment, the second segment, and the third segment also include a second channel located at a second distance from the center point. The second distance defines a second resonant section of the ferrite element.

20 Claims, 8 Drawing Sheets

(56) References Cited

U.S. PATENT DOCUMENTS

| | | | | |
|---|---|---|---|---|
| 2006/0250195 | A1 | 11/2006 | Kroening | |
| 2006/0261909 | A1 * | 11/2006 | Kroening | 333/1.1 |
| 2009/0108953 | A1 | 4/2009 | Kroening | |
| 2010/0109791 | A1 | 5/2010 | Lingel | |
| 2014/0049333 | A1 | 2/2014 | Kroening | |
| 2014/0049334 | A1 | 2/2014 | Kroening | |
| 2014/0049335 | A1 | 2/2014 | Kroening | |

FOREIGN PATENT DOCUMENTS

| | | | |
|---|---|---|---|
| JP | 51117853 | | 10/1976 |
| JP | 52152145 | | 12/1977 |
| SU | 1256109 | * | 9/1986 |
| WO | 8806807 | | 9/1988 |

OTHER PUBLICATIONS

European Patent Office, "European Search Report", "from Foreign Counterpart of U.S. Appl. No. 13/588,337", Nov. 26, 2013, pp. 1-4, Published in: EP.

European Patent Office, "European Search Report", "from Foreign Counterpart of U.S. Appl. No. 13/588,374", Dec. 9, 2013, pp. 1-3, Published in: EP.

European Patent Office, "Office Action", "from Foreign Counterpart of U.S. Appl. No. 13/588,314", Dec. 16, 2013, pp. 1-9, Published in: EP.

European Patent Office, "Office Action", "from Foreign Counterpart of U.S. Appl. No. 13/588,337", Dec. 9, 2013, pp. 1-6, Published in: EP.

European Patent Office, "Office Action from EP Application No. 13179326.7 mailed on Jan. 3, 2014", "from Foreign Counterpart of U.S. Appl. No. 13/588,374", Jan. 3, 2014, pp. 1-5, Published in: EP.

Billings et al., "Ferrite Circulator Switches and Their Applications", Nov. 2003, pp. 1-2.

Joubert, "Design of Unequal H-Plane Waveguide Power Dividers for Array Applications", Feb. 1997, pp. 1-6.

Liang et al., "A Rigorous Three Plane Mode-Matching Technique for Characterizing Waveguide T-Junctions, and its Application in Multiple", Dec. 12, 1991, pp. 2138-2147.

Lin Lin, "Theory and Design of Ferrite Latching Waveguide Junction Circulators", Dec. 1987, pp. 1-3.

Pozar, "10.6 Ferrite Circulators", Feb. 2004, pp. 1-4.

U.S. Patent and Trademark Office, "Office Action", "from U.S. Appl. No. 13/588,337", Mar. 25, 2014, pp. 1-20, Published in: US.

U.S. Patent and Trademark Office, "Notice of Allowance", "from U.S. Appl. No. 13/588,418", Mar. 26, 2014, pp. 1-22, Published in: US.

U.S. Patent and Trademark Office, "Office Action", "from U.S. Appl. No. 13/588,374", Apr. 17, 2014, pp. 1-26, Published in: US.

* cited by examiner

SWITCHING FERRITE CIRCULATOR WITH AN ELECTRONICALLY SELECTABLE OPERATING FREQUENCY BAND

BACKGROUND

Ferrite circulators have a wide variety of uses in commercial and military, space and terrestrial, and low and high power applications. A waveguide circulator may be implemented in a variety of applications, including but not limited to low noise amplifier (LNA) redundancy switches, T/R modules, isolators for high power sources, and switch matrices. One important application for such waveguide circulators is in space, especially in satellites where extreme reliability is essential and where size and weight are very important. Ferrite circulators are desirable for these applications due to their high reliability, as there are no moving parts required. This is a significant advantage over mechanical switching devices. In most of the applications for waveguide switching and non-switching circulators, small size, low mass, and low insertion loss are significant qualities.

A commonly used type of waveguide circulator has three waveguide arms arranged at 120° and meeting in a common junction. This common junction is loaded with a non-reciprocal material such as ferrite. When a magnetizing field is created in this ferrite element, a gyromagnetic effect is created that can be used for switching the microwave signal from one waveguide arm to another. By reversing the direction of the magnetizing field, the direction of switching between the waveguide arms is reversed. Thus, a switching circulator is functionally equivalent to a fixed-bias circulator but has a selectable direction of circulation. Radio frequency (RF) energy can be routed with low insertion loss from one waveguide arm to either of the two output arms. If one of the waveguide arms is terminated in a matched load, then the circulator acts as an isolator, with high loss in one direction of propagation and low loss in the other direction.

SUMMARY

In one embodiment, a ferrite element for a switchable circulator is provided. The ferrite element comprises a first segment extending in a first direction from a center portion of the ferrite element; a second segment extending in a second direction from the center portion of the ferrite element; and a third segment extending in a third direction from the center portion of the ferrite element. Each of the first segment, the second segment, and the third segment include a first channel located at a first distance from a center point of the ferrite element. The first distance defines a first resonant section of the ferrite element. Each of the first segment, the second segment, and the third segment also include a second channel located at a second distance from the center point. The second distance defines a second resonant section of the ferrite element.

DRAWINGS

Understanding that the drawings depict only exemplary embodiments and are not therefore to be considered limiting in scope, the exemplary embodiments will be described with additional specificity and detail through the use of the accompanying drawings, in which.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. The following detailed description is, therefore, not to be taken in a limiting sense.

Figure 1:
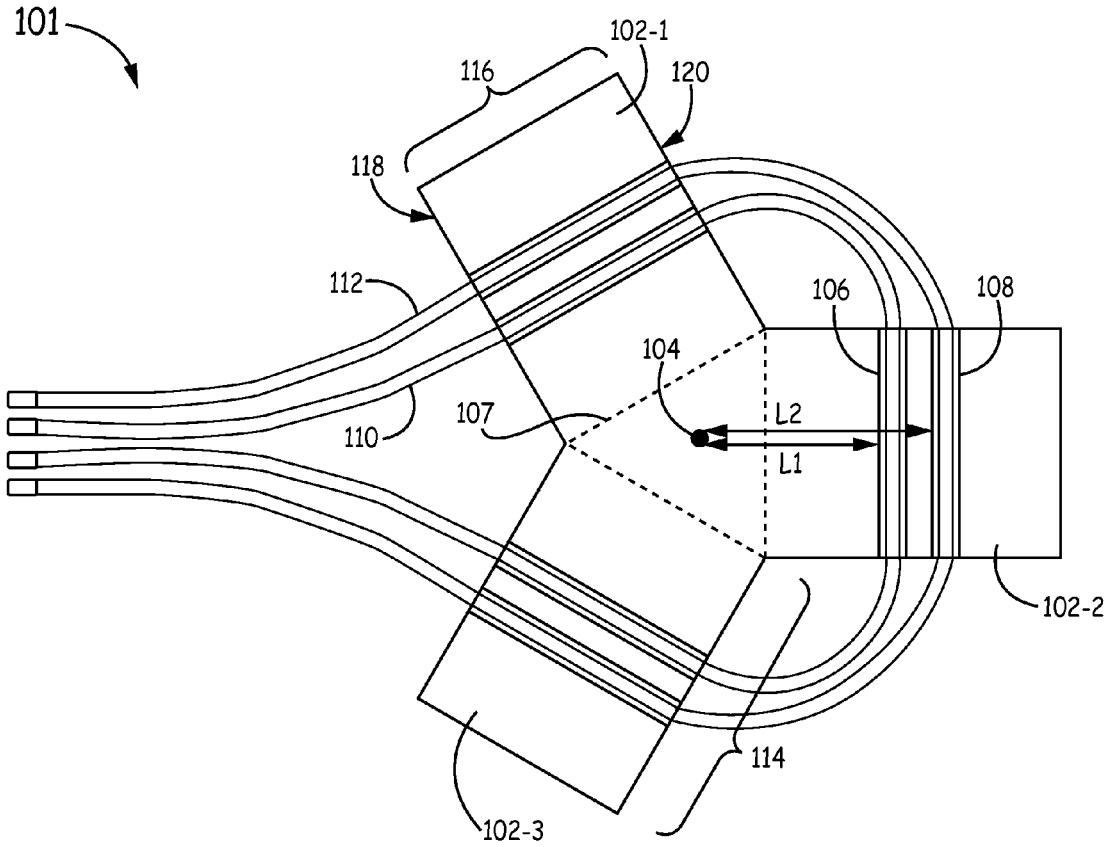
FIG. 1 is a top view of one embodiment of an exemplary ferrite element used in a switchable circulator.

FIG. 1 is a cross-sectional top view of one embodiment of an exemplary ferrite element 101 used in a switchable circulator. Ferrite element 101 includes 3 legs or segments 102-1, 102-2, and 102-3 which extend out from a center portion 107 at approximately 120° angles from one another. Each segment 102 has a length 114 and a width 116. The length 114 and width 116 of each leg 102 is approximately equal to the length 114 and width 116 of the other legs 102. In addition, each segment 102 includes a first inner channel 106 located a distance L1 from a center point 104 and a second outer channel 108 located a distance L2 from the center point 104. As used herein, the terms "channel", "aperture", and "hole" can be used interchangeably. The channels 106 and 108 begin at a first side 118 of each segment 102 and end at a second side 120 of each segment 102. The second side 102 is opposite the first side 118. Hence, the channels 106 and 108 extend through the width 116 of each segment 102 in a direction that is approximately perpendicular to the first side 118 and the second side 120.

Each of the channels 106 and 108 can be created by boring a hole through each leg 102 of the ferrite element 101, for example. If a magnetizing winding (also referred to herein as a wire) is inserted through each of the apertures 106 and 108, then a magnetizing field may be established in the ferrite element 101 by applying a current pulse to one of the magnetizing windings. For example, in some embodiments, the pulse length is on the order of 100 nanoseconds wide and 4-12 amps at its peak through the wire. The pulse latches the ferrite element 101 into a certain magnetization and then stops. Thus, current does not have to be continually applied to the selected wire.

In the example shown in FIG. 1, a wire 110 is inserted through channel 106 and a separate wire 112 is inserted through channel 108. The respective diameter of the channels 106 and 108 is determined based on the diameter of the current carrying wire 110, 112 placed through the respective channels 106 and 108. In particular, the respective diameter of channels 106 and 108 is greater than the diameter of the respective current carrying wire 110 or 112 such that the current carrying wire 110 or 112 can be inserted through the respective channels 106 and 108. The polarity of the magnetizing field may be switched, alternately, by switching the polarity of the current applied to the wire 110 or 112 to thereby provide a switchable circulator.

The length L1 to the first channel 106 is measured from the center point 104 to approximately a midpoint of the channel 106. Similarly, the length L2 to the second channel 108 is measured from the center point 104 to approximately a midpoint of the channel 108. The length from the center point 104 to the respective channel 106/108 influences the operating frequency of the switchable circulator in which the ferrite element 101 is implemented. In particular, the volume of the resonant section of the ferrite element 101 determines the frequency of operation to the first order. The resonant section of the ferrite element 101 includes the center portion 107 and the portion of each leg 102 between the center portion 107 of the Y-shaped ferrite element 101 and the location of the wire 110 or 112 carrying a current pulse. The sections of the ferrite element in the area outside of the resonant section volume may act as return paths for the bias fields in the resonant section and as impedance transformers out of the resonant section.

Hence, a control circuit can switch the operating frequency of the switchable circulator by switching application of an electrical current pulse between wires 110 and 112. That is, when an electrical current pulse is applied to wire 110, the switchable circulator will operate at a first frequency range based on the length L1. When an electrical current pulse is applied to wire 112, the switchable circulator will operate at a second frequency range based on the length L2. Thus, by configuring the lengths L1 and L2, a switchable circulator can be configured to selectively operate in two different frequency bands.

In addition, the lengths L1 and L2 can be selected based on performance of the switchable circulator at the respective frequency bands without regard to the operation of the switchable circulator over a guard band between the respective frequency bands. For example, in order for a conventional switchable circulator to operate over the first and second frequency bands, the conventional switchable circulator would need to be configured to operate over a continuous frequency spectrum which includes both the first and second frequency bands as well as a guard band between the first and second frequencies. Hence, this increases the difficulty in designing the switchable circulator and can lead to reduced performance over the desired frequency bands. However, a switchable circulator implementing the ferrite element 101 of FIG. 1 does not need to operate over the guard band. Hence, each length L1 and L2 can be selected in consideration of performance over the respective frequency band only.

Figure 2:
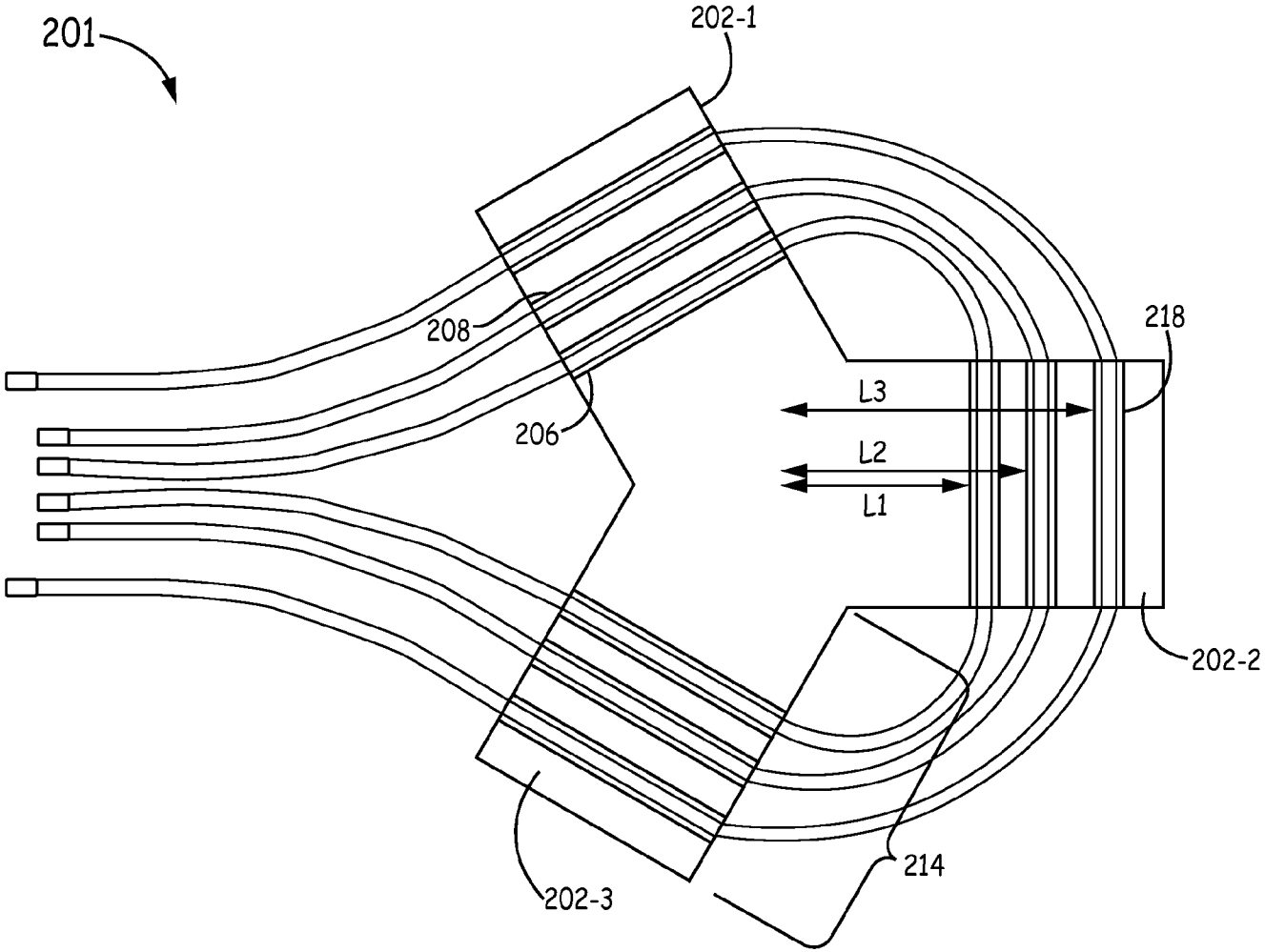
FIG. 2 is a top view of another embodiment of an exemplary ferrite element used in a switchable circulator.

Additionally, it is to be understood that embodiments of the ferrite element are not limited to two wires and corresponding channels. For example, as shown in FIG. 2, the ferrite element 201 includes three channels 206, 208, and 218 located at a distance L1, L2, and L3, respectively, from the center point 204. The number of channels is limited by the length 214 of the legs 202-1 . . . 202-3 and the diameter of the channels. In other words, the combined space required for the diameters of the plurality of channels cannot exceed a specified percentage of the length 214 of each leg 202.

Figure 3A:
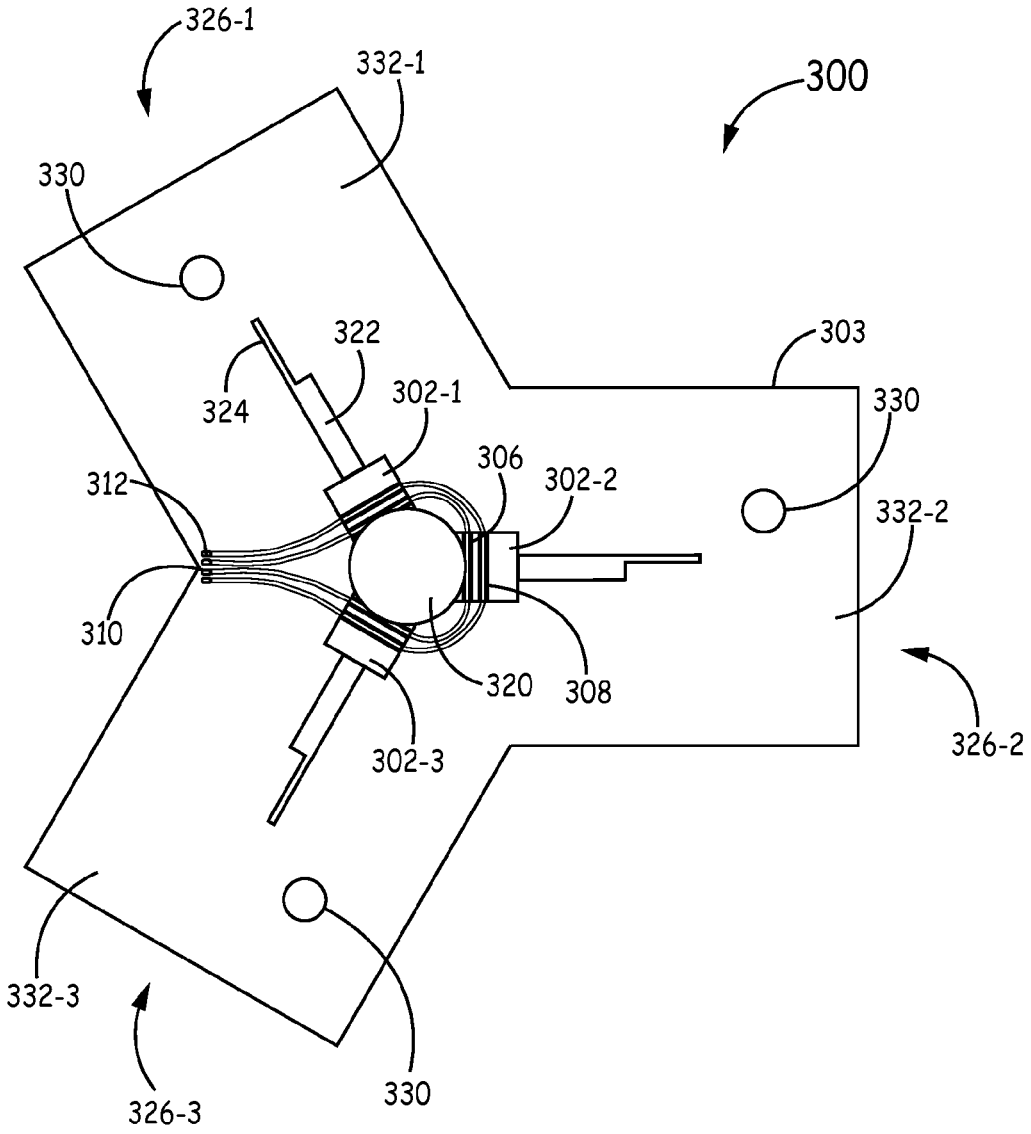
FIG. 3A is a top view of one embodiment of an exemplary switchable circulator.
Figure 3B:
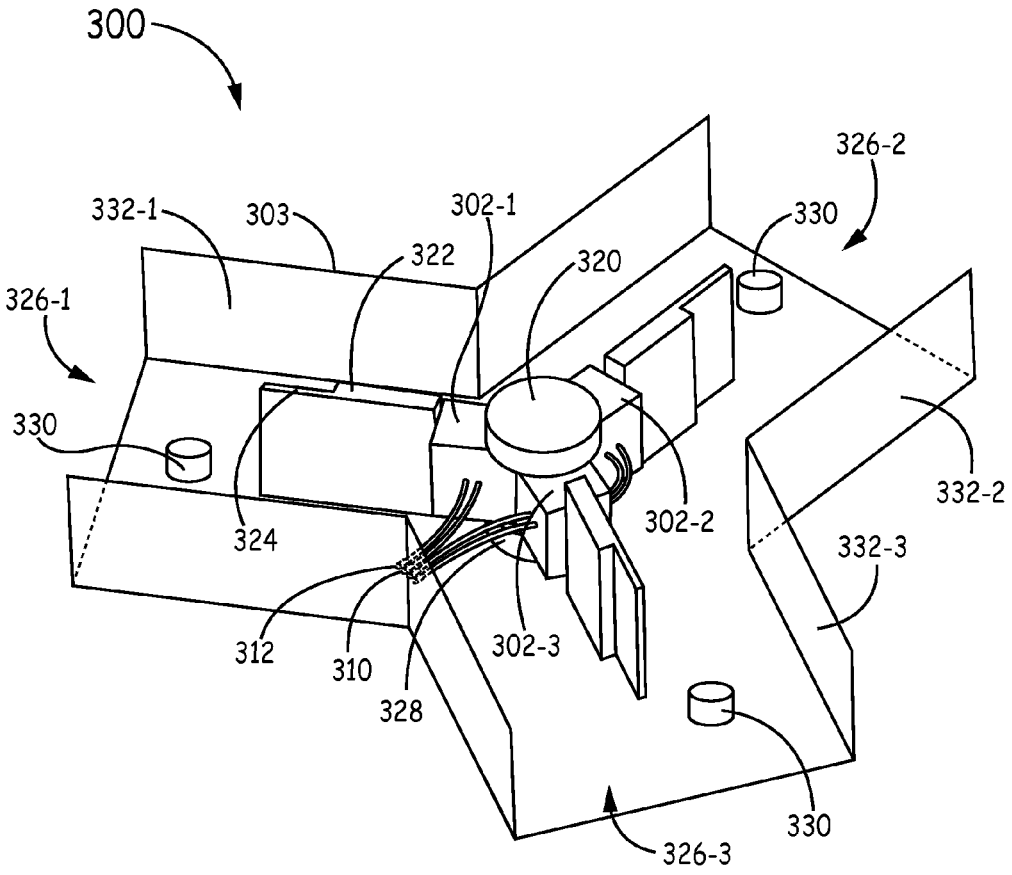
FIG. 3B is a perspective view of one embodiment of an exemplary switchable circulator.

FIG. 3A is a top view of an exemplary switchable circulator 300 and FIG. 3B is an isometric view of the exemplary switchable circulator 300. The switchable circulator 300 includes a waveguide structure 303 which defines a plurality of waveguide arms 332 that meet in a shared junction and are generally air-filled. For the purposes of this description, the terms "air-filled," "empty," "vacuum-filled," or "unloaded" may be used interchangeably to describe a waveguide structure. The arms 332 are arranged at approximately 120 degree angles from each other in this example. The conductive waveguide structure 303 may also include waveguide input/output ports 326-1 . . . 326-3. The ports 326 can be used to provide interfaces, such as for signal input and output, for example.

The switchable circulator 300 also includes a ferrite element 301 disposed in the air-filled waveguide structure 303, as shown in FIGS. 3A and 3B. Additionally, a dielectric spacer 320 is disposed on a top surface of ferrite element 301 and a dielectric spacer 328 is disposed on a bottom surface of the ferrite element 301. The materials selected for the respective spacers 320 and 328 can be chosen independently in terms of microwave and thermal properties to allow for more flexibility in the impedance matching of the circulator 300. The diameter of the spacers 320 and 328 are selected for impedance matching purposes. Although spacers 320 and 328 are shown in FIGS. 3A and 3B as having a circular shape, any geometry may be used for the spacers 320 and 328. In addition, in some embodiments, one or more empirical matching elements 330 can be optionally included on a conductive portion of the waveguide structure 303. The waveguide structure 303 can be comprised of any conductive material, such as, but not limited to, aluminum, silver plated metal, or gold plated metal. The matching elements 330 can be capacitive/inductive dielectric or metallic buttons that are used to empirically improve the impedance match over the desired operating frequency band.

In addition, in the example of FIG. 3, the switchable circulator 300 includes a two-step quarter-wave dielectric transformer 322 coupled to an end of each leg 302 of the ferrite element 301 for purposes of impedance matching the ferrite element to the waveguide interface. The dielectric transformers 322 are typically used to match the lower impedance of the ferrite element to the higher impedance of the air-filled waveguide so as to reduce loss. In particular, in this embodiment, the dielectric transformers 322 include a step 324 in the width of the transformer 322 for providing two steps of impedance matching. However, it is to be understood that the dimensions of the transformers 322 vary based on the desired impedance matching for the specific implementation. For example, the width, height, number of steps, and location of the steps in the transformers 322 can vary to thus achieve the desired impedance matching of the ferrite element 301 to the corresponding waveguide port 326. Additionally, in other embodiments, steps in the height or width of the waveguide arms 332 can be used in addition to or in lieu of variances in the dimensions of the transformers 322 to achieve the desired impedance matching.

The ferrite element 301 also includes a plurality of channels. In particular, in this example, the ferrite element 301 includes two channels 306 and 308 through each leg 302. Magnetizing windings 310 and 312 are each inserted through a corresponding one of the channels 306 and 308 to each define a different resonant section, as discussed above. The inside wire 310 provides higher frequency performance and the outside wire 312 provides lower frequency performance because the operating frequency is inversely related to the volume of the resonant section. Hence, the switchable circulator 300 is implemented as a multi-band nonreciprocal switchable circulator containing three ports 326. That is, by switching the magnetizing winding through which a current pulse is applied, the operating frequency of the switchable circulator 301 is switched. Hence, as used herein a multi-band switchable circulator is a circulator with an electronically selectable operating frequency band.

Additionally, by switching the polarity of the current pulse, the signal flow direction can be switched. For example, for a first polarity of the current pulse, a first signal flow configuration in the switchable three-port circulator 300 is 326-1→326-2, 326-2→326-3, and 326-3→326-1. That is a signal input via port 326-1 is output via port 326-2; a signal input via port 326-2 is output via port 326-3; and a signal input via 326-3 is output via port 326-1. For a second polarity of the current pulse, a second signal flow configuration in the switchable circulator 300 is 326-1→326-3, 326-3→326-2, and 326-2→326-1.

In an ideal configuration, no portion of the input signals should result on the isolated port. The isolated port is the port over which the signal is not intended to be output. For example, if a signal is input on port 326-1, the output port in the first signal flow configuration described above is port 326-2 and the isolated port is 326-3. Hence, ideally no signal should result on port 326-3 in such a configuration. Any loss in signal from the input port to the output port is referred to as the insertion loss. Loss in signal from the input port to the isolated port is referred to as isolation.

Figure 5A:
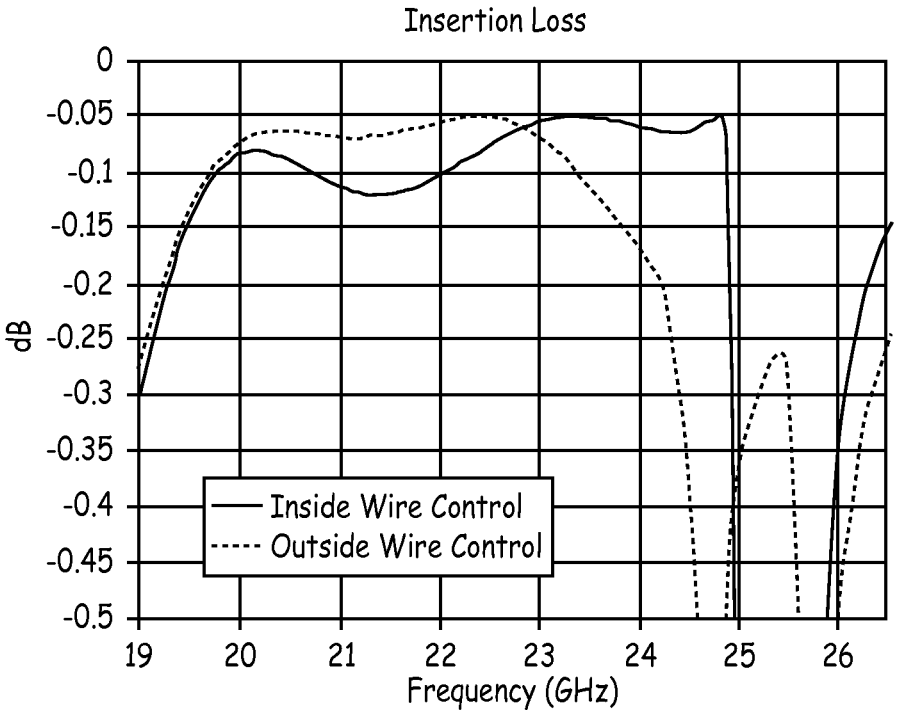
FIG. 5A is a graph representing exemplary insertion loss data for an exemplary embodiment of a multi-band switchable circulator.
Figure 5B:
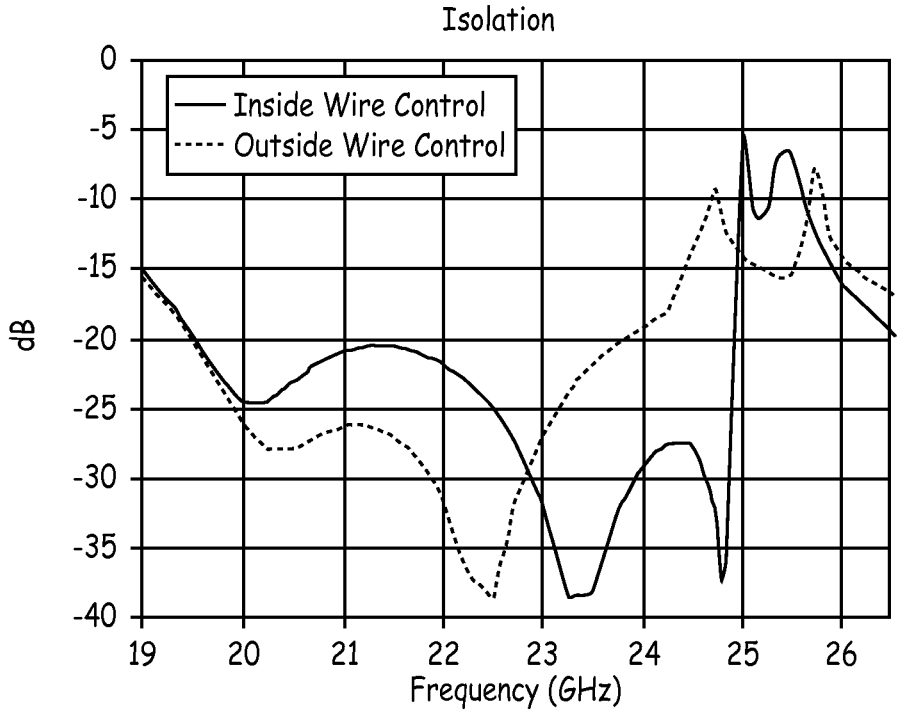
FIG. 5B is a graph representing exemplary isolation data for an exemplary embodiment of a multi-band switchable circulator.
Figure 5C:
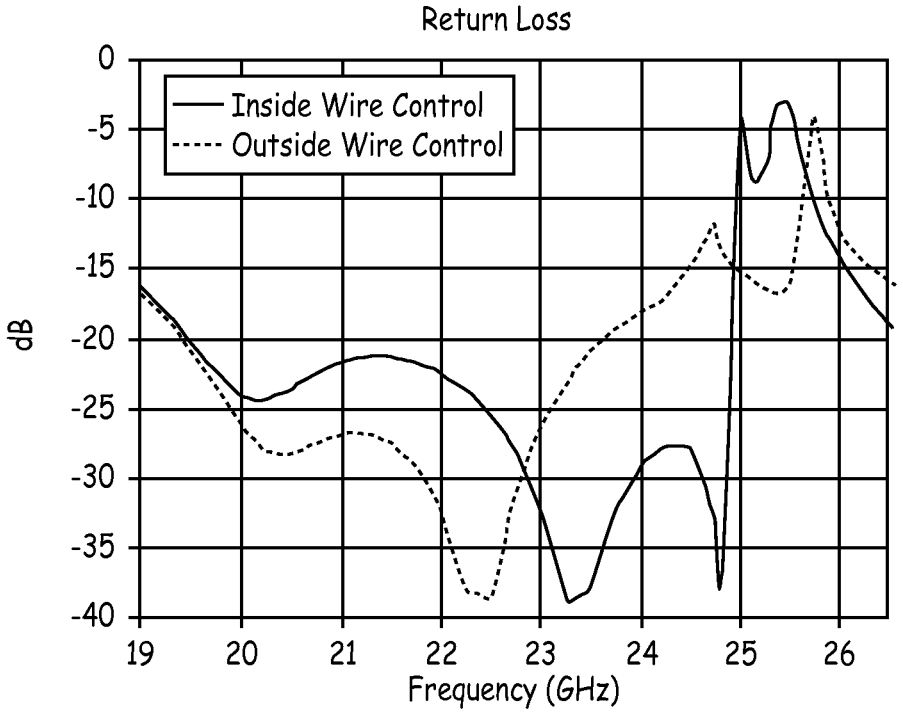
FIG. 5C is a graph representing exemplary return loss data for an exemplary embodiment of a multi-band switchable circulator.

It is typically desirable to configure the circulator 300 to decrease the insertion loss and increase the isolation. For example, in one embodiment, the circulator is configured to have a few tenths of a dB insertion loss and approximately 20 dB isolation. FIGS. 5A-5C are graphs representing exemplary insertion loss, isolation, and return loss data for an exemplary embodiment of the multi-band switchable circulator having two magnetizing windings for switching operation frequency. As can be seen in FIGS. 5A-5C, the frequency band over which the circulator performs with the desired insertion loss, isolation, and return loss is different depending on the wire to which the current pulse is applied. In particular, as discussed above, the inner wire, such as wire 310 in FIG. 3, that defines a smaller resonant section generally provides better performance at relatively higher operating frequencies than the outer wire, such as wire 312 in FIG. 3, that defines a larger resonant section. Similarly, the outer wire generally provides better performance at relatively lower operating frequencies than the inner wire. Thus, with a single switchable circulator, two separate frequency bands can be supported while attaining desired performance for both frequency bands.

Figure 4:
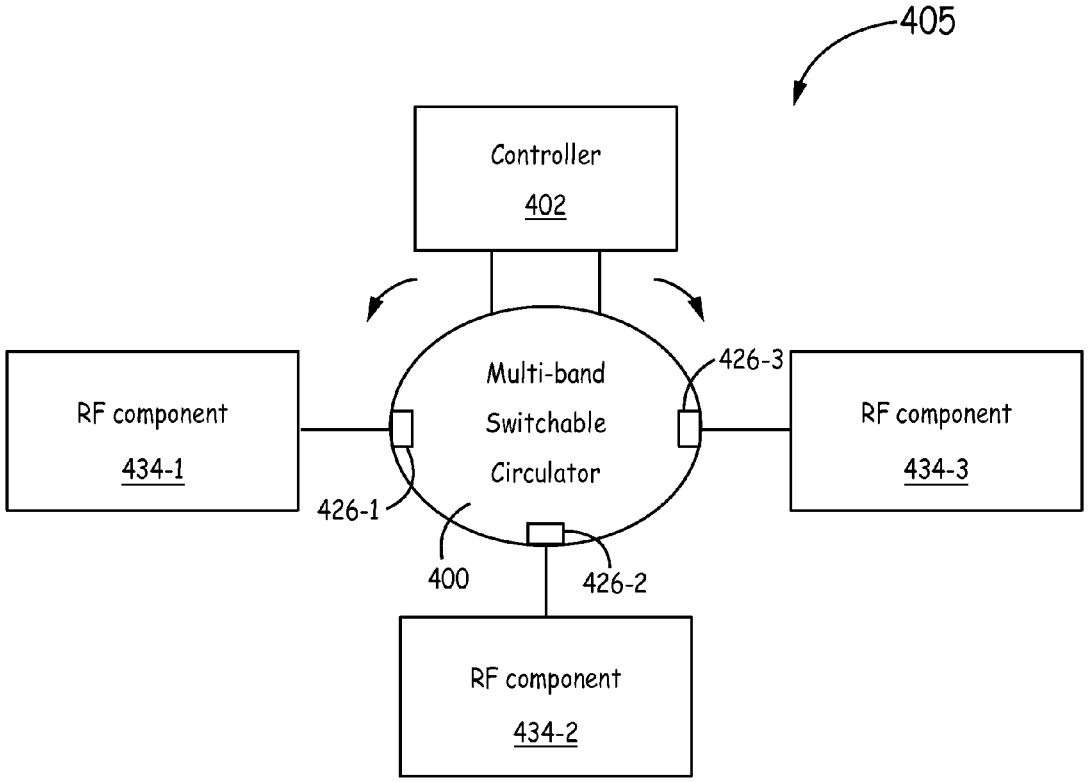
FIG. 4 is a high level block diagram of one embodiment of a system having a switchable circulator with a selectable operating frequency band.

FIG. 4 is a high level block diagram of one embodiment of a system 405 which implements a multi-band switchable circulator 400. System 405 can be implemented as any radio frequency (RF) system such as, but not limited to, radar systems, satellite communication systems, and terrestrial communications networks. The multi-band switchable circulator 400 includes a ferrite element having at least two wires inserted through corresponding apertures in each leg of a ferrite element as described above. Each of the at least two wires is associated with a respective operating frequency band based on the location of the corresponding aperture, as described above. The respective operating frequency bands do not have to be adjacent frequency bands. That is, a frequency at an upper edge of the lower frequency band does not have to be the same as or close to a frequency at a lower edge of the higher frequency band. The system 405 also includes a controller circuit 402 which is configured to provide a current pulse to one of the at least two wires to select an operating frequency band of the switchable circulator 400. Additionally, the controller circuit 402 can be optionally configured to switch the direction of signal flow as described above.

Coupled to each port 426 is an RF component 434. Each RF component 434 can be implemented as one of a transmitter, a receiver, an antenna, or other load known to one of skill in the art. For example, in one embodiment, RF component 434-1 is implemented as an antenna, RF component 434-2 is implemented as a receiver, and RF component 434-3 is implemented as a transmitter. The multi-band switchable circulator 400 is configured, in such an embodiment, so that signals from the transmitter 434-3 are isolated from the receiver 434-2, but are passed through to the antenna 434-1 for transmission. Similarly, signals received via antenna 434-1 are isolated from the transmitter 434-3 and passed through to the receiver 434-2 in such an example embodiment. The controller circuit 402 is configured to switch the operating frequency band by switching the wire to which the current pulse is applied. For example, the operating frequency band can be switched to a first frequency band for transmission of signals and to a second frequency band for reception of signals. However, it is to be understood that, in other embodiments, the RF components 434 are implemented differently than in this exemplary embodiment.

Hence, through the use of the multi-band switchable circulator 400, the system 405 is able to support multiple frequency bands with a single switchable circulator. Additionally, the multiple frequency bands do not need to be adjacent bands. For example, the frequency bands can be separated by a guard band to avoid interference between the bands. As described above, through the use of multiple wires through the legs of the multi-band switchable circulator 400, the circulator 400 can be configured to operate at a desired performance level for each of the frequency bands without regard to performance of the circulator 400 over the guard band.

EXAMPLE EMBODIMENTS

Example 1 includes a ferrite element for a switchable circulator, the ferrite element comprising: a first segment extending in a first direction from a center portion of the ferrite element; a second segment extending in a second direction from the center portion of the ferrite element; and a third segment extending in a third direction from the center portion of the ferrite element; wherein each of the first segment, the second segment, and the third segment include a first channel located at a first distance from a center point of the ferrite element, the first distance defining a first resonant section of the ferrite element; wherein each of the first segment, the second segment, and the third segment include a second channel located at a second distance from the center point, the second distance defining a second resonant section of the ferrite element; wherein the first channel is sized to enable a first wire capable of carrying a current pulse to be passed through the first channel; and wherein the second channel is sized to enable a second wire capable of carrying a current pulse to be passed through the second channel.

Example 2 includes the ferrite element of Example 1, wherein each of the first segment, the second segment, and the third segment include a third channel located at a third distance from the center point, the third channel defining a third resonant section of the ferrite element; wherein the third channel is sized to enable a third wire capable of carrying a current pulse to be passed through the third channel.

Example 3 includes the ferrite element of any of Examples 1-2, wherein the first segment, the second segment, and the third segment are arranged at approximately 120 degree angles from one another.

Example 4 includes a switchable circulator comprising: a waveguide having three ports; a ferrite element having three segments that each extend from a center portion, the ferrite element having a first resonant section defined by a first channel in each of the three segments and a second resonant section defined by a second channel in each of the three segments; a first magnetizing winding disposed in the first channel in each of the three segments; and a second magnetizing winding disposed in the second channel in each of the three segments; wherein, when a current pulse is applied to the first magnetizing winding, the switchable circulator operates in a first frequency band determined by the first resonant section; and wherein, when a current pulse is applied to the second magnetizing winding, the switchable circulator operates in a second frequency band determined by the second resonant section.

Example 5 includes the switchable circulator of Example 4, further comprising a dielectric spacer disposed on at least one of a top surface of the ferrite element or a bottom surface of the ferrite element.

Example 6 includes the switchable circulator of any of Examples 4-5, further comprising a respective dielectric transformer coupled to an end of each of the three segments of the ferrite element.

Example 7 includes the switchable circulator of any of Examples 4-6, wherein the waveguide structure defines three arms that are arranged at approximately 120 degree angles from one another and meet at a common junction, each arm corresponding to one of the three ports.

Example 8 includes the switchable circulator of any of Examples 4-7, further comprising a third magnetizing winding disposed in a third channel in each of the three segments of the ferrite element, the third channel defining a third resonant section of the ferrite element, wherein, when a current pulse is applied to the third magnetizing winding, the switchable circulator operates in a third frequency band determined by the third resonant section.

Example 9 includes the switchable circulator of any of Examples 4-8, wherein the three segments of the ferrite element are arranged at approximately 120 degree angles from one another.

Example 10 includes the switchable circulator of any of Examples 4-9, further comprising one or more empirical impedance matching elements disposed on a conductive portion of the waveguide.

Example 11 includes the switchable circulator of Example 10, wherein the one or more impedance matching elements are capacitive dielectrics.

Example 12 includes a system comprising: a multi-band switchable circulator comprising: a waveguide structure having three ports; a ferrite element disposed in the waveguide structure and comprising three segments that each extend from a center portion, wherein the ferrite element has a first resonant section defined by a first channel in each of the three segments and a second resonant section defined by a second channel in each of the three segments; wherein a first wire is disposed in the first channel and a second wire is disposed in the second channel; the system further comprising: a controller circuit coupled to the first wire and to the second wire, the controller circuit configured to selectively apply a current pulse to one of the first wire and the second wire; and at least one radio frequency (RF) component coupled to a respective one of the ports in the waveguide structure; wherein the multi-band switchable circulator is configured to operate in a first frequency band when the controller circuit applies a current pulse to the first wire and to operate in a second frequency band when the controller applies a current pulse to the second wire.

Example 13 includes the system of Example 12, wherein the multi-band switchable circulator further comprises a dielectric spacer disposed on at least one of a top surface of the ferrite element or a bottom surface of the ferrite element.

Example 14 includes the system of any of Examples 12-13, wherein the multi-band switchable circulator further comprises a respective dielectric transformer coupled to an end of each of the three segments of the ferrite element.

Example 15 includes the system of any of Examples 12-14, wherein the waveguide structure defines three arms that are arranged at approximately 120 degree angles from one another and meet at a common junction, each arm corresponding to one of the three ports.

Example 16 includes the system of any of Examples 12-15, wherein the ferrite element has a third resonant section defined by a third channel in each of the three segments; wherein a third wire is disposed in the third channel; wherein the controller circuit is coupled to the third wire and the multi-band switchable circulator is configured to operate in a third frequency band when the controller circuit applies a current pulse to the third wire.

Example 17 includes the system of any of Examples 12-16, wherein the three segments of the ferrite element are arranged at approximately 120 degree angles from one another.

Example 18 includes the system of any of Examples 12-17, wherein the multi-band switchable circulator further comprises one or more empirical impedance matching elements disposed on a conductive portion of the waveguide structure.

Example 19 includes the system of Example 18, wherein the one or more impedance matching elements are metallic buttons.

Example 20 includes the system of any of Examples 12-19, wherein the first frequency band and the second frequency band are not adjacent frequency bands.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A ferrite element for a switchable circulator, the ferrite element comprising:

a first segment extending in a first direction from a center portion of the ferrite element;

a second segment extending in a second direction from the center portion of the ferrite element; and a third segment extending in a third direction from the center portion of the ferrite element;

wherein each of the first segment, the second segment, and the third segment include a first channel located at a first distance from a center point of the ferrite element, the first distance defining a first resonant section of the ferrite element;

wherein each of the first segment, the second segment, and the third segment include a second channel located at a second distance from the center point, the second distance defining a second resonant section of the ferrite element;

wherein the first channel is sized to enable a first wire capable of carrying a current pulse to be passed through the first channel;

wherein the second channel is sized to enable a second wire capable of carrying a current pulse to be passed through the second channel;

wherein, when a current pulse is applied to the first wire, performance of the switchable circulator operating in a first frequency band meets desired performance levels better than when a current pulse is applied to the second wire; and wherein, when a current pulse is applied to the second wire, performance of the switchable circulator operating in a second frequency band meets desired performance levels better than when a current pulse is applied to the first wire.

2. The ferrite element of claim 1, wherein each of the first segment, the second segment, and the third segment include a third channel located at a third distance from the center point, the third channel defining a third resonant section of the ferrite element;

wherein the third channel is sized to enable a third wire capable of carrying a current pulse to be passed through the third channel.

3. The ferrite element of claim 1, wherein the first segment, the second segment, and the third segment are arranged at approximately 120 degree angles from one another.

4. A switchable circulator comprising:

a waveguide having three ports;

a ferrite element having three segments that each extend from a center portion, the ferrite element having a first resonant section defined by a first channel in each of the three segments and a second resonant section defined by a second channel in each of the three segments;

a first magnetizing winding disposed in the first channel in each of the three segments; and a second magnetizing winding disposed in the second channel in each of the three segments;

wherein, when a current pulse is applied to the first magnetizing winding, performance of the switchable circulator operating in a first frequency band meets desired performance levels better than when a current pulse is applied to the second magnetizing winding; and wherein, when a current pulse is applied to the second magnetizing winding, performance of the switchable circulator operating in a second frequency band meets desired performance levels better than when a current pulse is applied to the first magnetizing winding.

5. The switchable circulator of claim 4, further comprising a dielectric spacer disposed on at least one of a top surface of the ferrite element or a bottom surface of the ferrite element.

6. The switchable circulator of claim 4, further comprising a respective dielectric transformer coupled to an end of each of the three segments of the ferrite element.

7. The switchable circulator of claim 4, wherein the waveguide structure defines three arms that are arranged at approximately 120 degree angles from one another and meet at a common junction, each arm corresponding to one of the three ports.

8. The switchable circulator of claim 4, further comprising a third magnetizing winding disposed in a third channel in each of the three segments of the ferrite element, the third channel defining a third resonant section of the ferrite element, wherein, when a current pulse is applied to the third magnetizing winding, the switchable circulator operates in a third frequency band determined by the third resonant section.

9. The switchable circulator of claim 4, wherein the three segments of the ferrite element are arranged at approximately 120 degree angles from one another.

10. The switchable circulator of claim 4, further comprising one or more empirical impedance matching elements disposed on a conductive portion of the waveguide.

11. The switchable circulator of claim 10, wherein the first frequency band and the second frequency band are separated by a guard band; and wherein performance of the switchable circulator in the guard band does not meet desired performance levels regardless of whether a current pulse is applied to the first magnetizing winding or the second magnetizing winding.

12. A system comprising:

a multi-band switchable circulator comprising:

a waveguide structure having three ports;

a ferrite element disposed in the waveguide structure and comprising three segments that each extend from a center portion, wherein the ferrite element has a first resonant section defined by a first channel in each of the three segments and a second resonant section defined by a second channel in each of the three segments;

wherein a first wire is disposed in the first channel and a second wire is disposed in the second channel;

the system further comprising:

a controller circuit coupled to the first wire and to the second wire, the controller circuit configured to selectively apply a current pulse to one of the first wire and the second wire; and at least one radio frequency (RF) component coupled to a respective one of the ports in the waveguide structure;

wherein the multi-band switchable circulator is configured to operate in a first frequency band when the controller circuit applies a current pulse to the first wire and to operate in a second frequency band when the controller applies a current pulse to the second wire;

wherein, when a current pulse is applied to the first wire, performance of the multi-band switchable circulator operating in a first frequency band meets desired performance levels better than when a current pulse is applied to the second wire; and wherein, when a current pulse is applied to the second wire, performance of the multi-band switchable circulator operating in a second frequency band meets desired performance levels better than when a current pulse is applied to the first wire.

13. The system of claim 12, wherein the multi-band switchable circulator further comprises a dielectric spacer disposed on at least one of a top surface of the ferrite element or a bottom surface of the ferrite element.

14. The system of claim 12, wherein the multi-band switchable circulator further comprises a respective dielectric transformer coupled to an end of each of the three segments of the ferrite element.

15. The system of claim 12, wherein the waveguide structure defines three arms that are arranged at approximately 120 degree angles from one another and meet at a common junction, each arm corresponding to one of the three ports.

16. The system of claim 12, wherein the ferrite element has a third resonant section defined by a third channel in each of the three segments;

wherein a third wire is disposed in the third channel;

wherein the controller circuit is coupled to the third wire and the multi-band switchable circulator is configured to operate in a third frequency band when the controller circuit applies a current pulse to the third wire.

17. The system of claim 12, wherein the three segments of the ferrite element are arranged at approximately 120 degree angles from one another.

18. The system of claim 12, wherein the first frequency band and the second frequency band are separated by a guard band; and wherein performance of the multi-band switchable circulator in the guard band does not meet desired performance levels regardless of whether a current pulse is applied to the first magnetizing winding or the second magnetizing winding.

19. The system of claim 12, wherein the multi-band switchable circulator further comprises one or more empirical impedance matching elements disposed on a conductive portion of the waveguide structure.

20. The system of claim 19, wherein the one or more impedance matching elements are metallic buttons.

* * * * *